United States Patent [19]

Muck

[11] Patent Number: 4,531,675

[45] Date of Patent: Jul. 30, 1985

[54] SPRAY NOZZLE

[75] Inventor: Jack E. Muck, Garfield Heights, Ohio

[73] Assignee: AccuSpray, Inc., Cleveland, Ohio

[21] Appl. No.: 545,089

[22] Filed: Oct. 25, 1983

[51] Int. Cl.[3] ..... B05B 1/26

[52] U.S. Cl. ..... 239/290; 239/301

[58] Field of Search ..... 239/290, 296, 297, 300, 239/301, 456

[56] References Cited

U.S. PATENT DOCUMENTS 2,740,670 4/1956 Harder ..... 239/301

3,037,709 6/1962 Bok et al. ..... 239/290

*Primary Examiner*—James B. Marbert

*Attorney, Agent, or Firm*—Sidney W. Millard

[57] ABSTRACT

An improved spray nozzle for use with air atomizable liquids wherein the spray pattern created by the atomizing nozzle may be adjusted from a circular pattern to a flat pattern or alternatively to an open oval, the open end facing in preselected directions, the adjustments being capable of occuring during the continuous operation of the nozzle. A pattern adjusting plate may be movably aligned with the pattern adjusting nozzles thereby creating the appropriate combination of pattern adjusting nozzles to create the desired pattern.

8 Claims, 6 Drawing Figures

SPRAY NOZZLE

FIELD OF THE INVENTION

The invention relates to an improved spray nozzle, and more particularly relates to an improved spray nozzle for use with air atomizable liquids.

BACKGROUND OF THE INVENTION

Spray nozzles, especially those used with spray painting systems, atomize the liquid paint by means of atomizing air which enters the nozzle via a chamber which surrounds a fluid nozzle. The atomizing air is then impinged on the end of the chamber and exits via a central aperture located at the end of the chamber. The liquid, paint, is atomized by the violent forward motion of this air as it exits the nozzle via the aperture. The initial pattern of the atomized liquid and air mixture is a circle. The term pattern is defined as and used herein to describe a cross section of the atomized liquid cloud in a plane perpendicular to the direction of the spray of the fluid nozzle. When the compressed air source for a spray painting apparatus utilizes a high volume, low pressure compressor, it is conventional for the nozzle on the spray painting gun to have a central aperture which is considerably larger than the fluid nozzle. Therefore, the large amount of air utilized in a conventional nozzle is due to the relative size of the central aperture to that of the fluid nozzle. This excess air, air beyond that required to atomize the liquid properly, constitutes an energy waste as well as a pollution problem. The air is a pollution problem since the air in a paint system will tend to carry the paint solvent and the more air that is used the more dilute the solvent and the more air that must be processed for the removal of solvents utilizing extremely difficult low concentration removal techniques.

Therefore, there is a need for an improved spray nozzle which utilizes less air, and more efficiently utilizes the air that it actually uses.

The pattern of a spray nozzle is conventionally adjusted by impinging additional air jets into the original circular pattern. Standardly two jets produce a flat or oval pattern, and if those jets are very powerful it produces a flat fan type spray pattern which is many times longer than it is wide. However, in production line spraying, there are needs for other than such a flat or oval pattern, especially when spray painting the reverse sides of objects or spray painting in an out-of-position way and also the traditional problem of painting the insides of angular surfaces.

Therefore, there is also a need for improved pattern control in spray nozzle systems and the ability to adjust the pattern to other than a flat or oval pattern. It would additionally be desirable if such adjustments or modifications of the pattern could be achieved without the necessity of changing the nozzle in use.

SUMMARY OF THE INVENTION

An improved spray nozzle according to this invention is achieved by having at the end of the atomizing chamber a central aperture through which the unadjusted atomized liquid spray is directed. The central aperture has a converging frusto-conical surface that acts to directionalize and streamline the atomizing air. Immediately adjacent the converging frusto-conical surface of the aperture is a turbulence creating diverting surface against which the atomized air impinges prior to entering the central aperture.

Another aspect of the present invention is a pattern adjusting plate which adjusts the air flow to the pattern adjusting nozzles which can be directed at the atomized liquid spray.

The present invention additionally provides for a method utilizing a nozzle having the features described above during the continuous use of that nozzle.

DESCRIPTION OF THE DRAWINGS

The best mode contemplated in carrying out this invention is illustrated in the accompanying drawings in which.

DESCRIPTION OF THE PREFERRED EMBODIMENT

Figure 1:
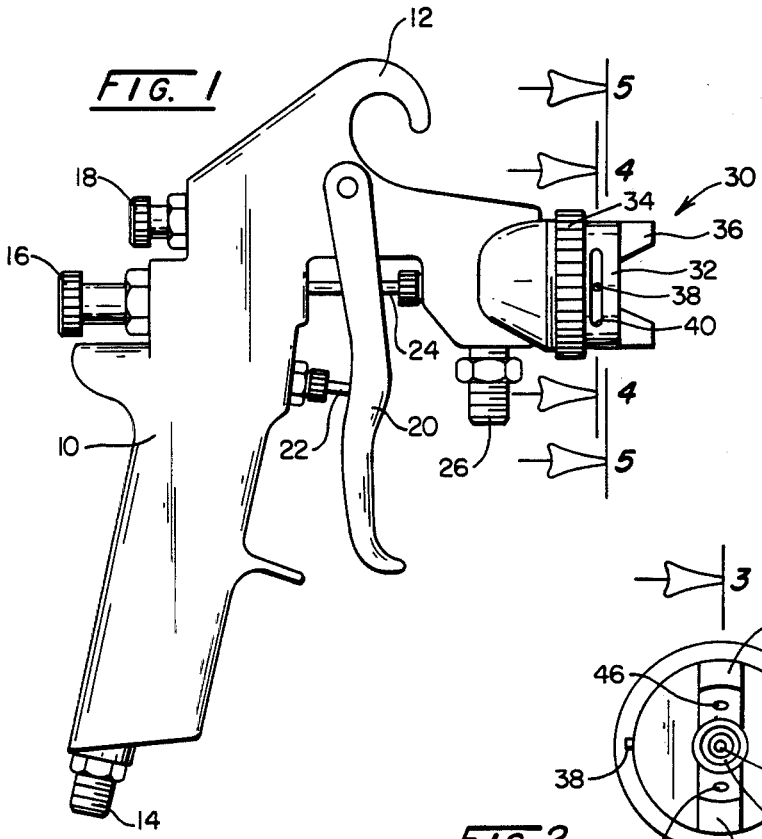
FIG. 1 is an elevational view of a paint spray assembly utilizing a nozzle according to the present invention.

With reference to the drawings, FIG. 1 shows a conventional paint spray gun which utilizes a nozzle according to the present invention. The conventional spray painting gun has a pistol type grip handle on a body 10 and can optionally have a hook assembly 12 for hanging the gun up after work has been completed or for temporary storage. An air supply fitting 14 provides a source of low pressure constant volume compressed air to the spray painting assembly. Within the body of the spray gun 10 the air supply is split into two separate streams which are separately regulable by means of adjustment knobs 16 and 18. Typically, air flow adjustment knob 16 would control the atomizing air to the nozzle while control knob 18 would adjust the flow rate of pattern pressing air to the nozzle, the function of these two different air supplies is described in more detail below. The paint gun body 10 also has a spring loaded trigger assembly 20 which is a hand held grip, the grip being held in its closed position by a spring loaded rod 22 projecting into the base of the handle. Additionally a pull rod 24 is moved by the trigger assembly, pull rod 24 adjusting the flow of paint to the nozzle tip while paint supply port 26 provides direct access to the supply of paint.

Figure 6:
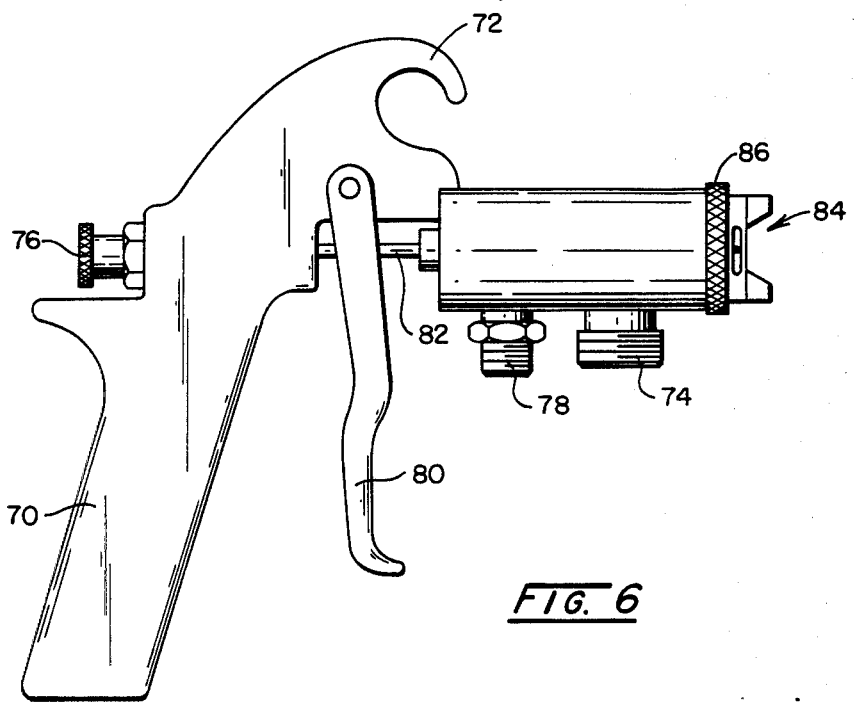
FIG. 6 is an elevational view of an alternative form of paint spray assembly with nozzle according to the present invention.

Referring to FIG. 6 which is an elevational view of an alternative spray paint gun, the handle assembly 70 is complete with a hook 72 at its upper surface for the purpose of hanging the gun between use as previously described. Atomizing air enters at atomizing air connection 74, the amount of air flowing through atomizing air connection 74 being controllable by an atomizing air control knob 76 which is mounted on the back of handle 70. The paint connection 78 is located in the conventional position but immediately adjacent the atomizing air connection 74. The flow of paint is regulable by moving handle 80 which moves pin 82, pin 82 being attached to the fluid nozzle within the nozzle assembly, not shown in this view. A nozzle assembly 84, according to the present invention is attached to the paint gun assembly by means of collar 86 in the conventional way.

Turning now to greater detail of the nozzle itself, in FIG. 1 nozzle assembly 30 comprises a nozzle body 32 which houses the various air chambers and supports the entire assembly. The nozzle body 32 is removably attached to the spray paint gun assembly and body 10 by means of screw type clamping device 34 which is a threaded collar. The nozzle body 32 is held in a leak-tight way against the spray paint gun assembly with a gasket that is not shown and that is compressed by the threaded collar 34. Additionally nozzle ears 36 are provided on the front face of nozzle body 32, that face of the nozzle body 32 being the end of the air chambers that are further described below. There are a plurality of nozzle ears 36, the most common number being two that are located 180° apart from each other on the circular face of the nozzle body 32. Additionally shown in FIG. 1 is spray pattern adjusting lever 38 and the slot 40 which retains the spray pattern adjusting lever 38.

Figure 2:
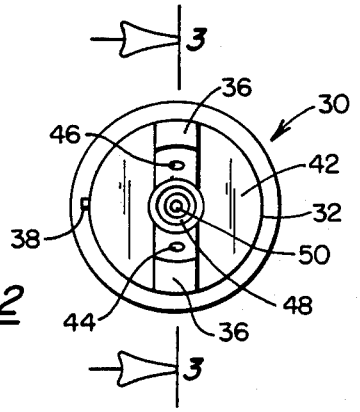
FIG. 2 is an end view of the nozzle of FIG. 1.

Turning now to FIG. 2 which is an end view of nozzle assembly 30, looking from the end upon which the nozzle ears 36 are provided, the nozzle ears 36 as indicated are on nozzle body 32 and more specifically are located on the external end face 42 of nozzle body 32. Spray pattern adjustment lever 38 can be clearly seen in this view. The faces 44 of nozzle ears 36 are formed in a concave way so as to control the direction of the air blast of the nozzle adjusting air, which is more completely described below. Within the concave nozzle ear faces 44 are pattern adjusting nozzles 46 which are orifices connected to the air chambers within nozzle assembly 30 and which are not shown in this view but are more completely described below. Additionally shown in the end view of the nozzle assembly is fluid nozzle valve 48 and fluid stop pin 50. Fluid stop pin 50 is the extension of pull rod 24 which is adjusted by means of the spring loaded trigger 20.

Figure 3:
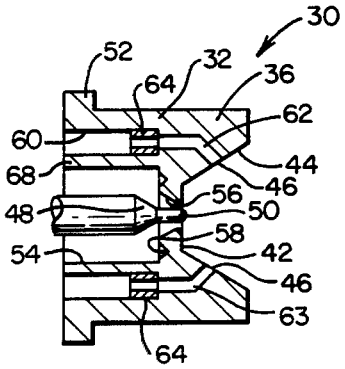
FIG. 3 is a cross sectional view taken along line 3—3 of the nozzle of FIG. 2.

A cross section of the spray nozzle assembly 30 is shown in FIG. 3. At the base of nozzle body 32 is a flange assembly 52 which is the flange assembly engaged by collar 34 to hold the nozzle assembly against the spray paint gun body 10. In this view atomizing air chamber 54 is shown with fluid nozzle valve 48 penetrating it, atomizing air chamber 54 having a central aperture 56 located at its outlet end. It will be noted that the central aperture 56 has a converging frusto-conical shaped surface. Preferably the frusto-conical shaped surface of central aperture 56 has a frusto-conical slope corresponding to the converging conical end of fluid nozzle valve 48. Additionally the end of atomizing air chamber 54 is shown to have a diverting surface 58 machined into it, the function of which is more further described below.

As the atomizing air enters atomizing air chamber 54, it proceeds against the outlet end of the chamber and the diverting surface 58 acts to create a turbulent area so that the air does not simply randomly "slide" out of the central aperture 56. Additionally the central aperture 56 has been provided as a converging frusto-conical surface tapering in a decreasing way from the inside of chamber 54 to the outside at surface 42. This converging frusto-conical shaping corresponds to the converging frusto-conical shaping of the fluid nozzle valve 48 so as to create a control in the flow of air to better atomize the fluid that is being drawn from the fluid nozzle. The use of a substantially straight-line aperture being created by the corresponding and cooperating frusto-conical surfaces of the aperture and the fluid nozzle gives a streamlining and directionalizing to the turbulent yet highly energetic air qualities of the atomizing air. The streamlining and directionalizing of this air allows for greater efficiency in utilization of the air since it is only the air that is operating in a straight line that will properly produce the vortex to withdraw the paint from the fluid nozzle and atomize that fluid. In the spray nozzles known in the prior art, there was substantially no thickness in the material at the aperture itself. Therefore, when the air impinged the end of the atomizing air chamber in the prior art nozzle it would simply bounce or "slide" out of the central aperture. Additionally since there was no thickness to the aperture itself, contrary to the present invention, there was no directionalization of the air thus requiring a greater quantity of air in order to achieve the proper amount of atomization. Because the air was not streamlined or directionalized, only the atomizing air that was heading in the proper directions by purely random action actually caused the vortex and atomizing affects, most of the other air being wasted. Additionally, it is clear that according to this invention the open area of the central aperture 56 can be adjusted by movement of the fluid nozzle valve 48 relative to the aperture. An adjustable aperture allows for optimizing atomizing air flow.

Additionally shown in cross sectional view of FIG. 3 are the details of the pattern adjusting air chamber provided according to the present invention. Pattern adjusting air flows into pattern adjusting air chamber 60 and flows through a port 62 which leads to pattern adjusting nozzle 46. The entrance to port 62 at the end of pattern adjusting air chamber 60 may be blocked by pattern adjusting plate 64 which is preferably a metal ring with ports drilled therein. The function of pattern adjusting plate 64 is more fully described below.

The pattern adjusting air enters pattern adjusting air chamber 60 and proceeds out to pattern adjusting nozzle 46, provided pattern adjusting plate 64 allows passage, the pattern adjusting air stream then impinges the atomized air stream emanating from aperture 56 in the face 42 of the spray nozzle assembly 30. Pattern adjusting air acts to compress the usually circular pattern shape of the atomized fluid and air mixture into an oval, or flat pattern. Conventionally two streams of pattern adjusting air are provided from pattern adjusting nozzles which are located 180° apart on the face of the nozzle. The action of the two together is to squeeze the circular pattern into the above described oval. The function of the pattern adjusting plate is to allow for utilization of one or the other of the normally two available pattern adjusting nozzles thereby allowing either one or two or none of the pattern adjusting nozzles to impinge its pattern adjusting air against the atomized fluid and air stream of the central circular spray. If two adjusting air nozzles are in operation the result is as conventionally described above, however if only one of the nozzles is utilized the result is an off center oval spray that looks more like a fan pattern in cross section either to the right or to the left, or up and down depending upon the orientation of the nozzle ears. The pattern adjusting plate is a movable plate allowing adjustment between a circular pattern (with no pattern adjusting nozzles in operation), a right, left/up, down open oval spray; or a traditional flat or long oval pattern.

In the preferred embodiment, the diverting surface is concentrically disposed about the frusto-conical central aperture on the inside surface of the outlet end of the atomizing air chamber. Additionally, the adjusting air chamber is annularly and concentrically disposed about the atomizing air chamber, therefore necessitating the annular ring shape of the pattern adjusting plate so that the pattern adjusting plate can fit into the annularly and concentrically disposed adjusting air chamber.

Figure 4:
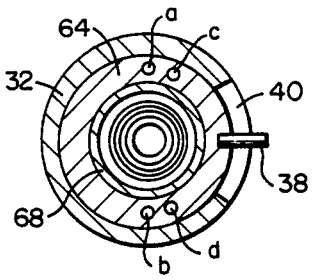
FIG. 4 is a cross sectional view taken along line 4—4 of the nozzle of FIG. 1.

Turning now to FIG. 4 which shows in cross section the portion of the nozzle of the present invention occupied by the pattern adjusting ring 64 as located within nozzle body 32. Looking also to FIG. 5 which is a cross section taken immediately adjacent the ring shape pattern adjusting plate showing the entrance to ports 62 at the end of pattern adjusting air chamber 60. In viewing both FIGS. 4 and 5 together, when the pattern adjusting plate port a is aligned with port 62, port b is also aligned with the corresponding port 63, pattern adjusting plate ports a and b having the same relationship to the ring as ports 62 and 63 have to the nozzle assembly. By utilizing spray pattern adjusting lever 38 port c in pattern adjusting plate 64 may be aligned with port 62. However it will be noted that when ring 64 is rotated to a position aligning port c with port 62, neither port b or d will be aligned with port 63. Alternatively spray pattern adjusting lever 38 may be utilized to adjust pattern adjusting plate 64 to align port d with port 63 and in this case it will be noted that neither port a nor port c will be aligned with port 62. Additionally although not shown there may be positions for pattern adjusting lever 38 in which none of the ports a,b,c, or d will be aligned with either ports 62 or 63.

Figure 5:
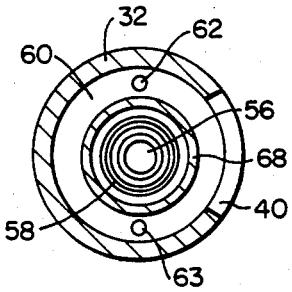
FIG. 5 is a cross sectional view taken along line 5—5 of the nozzle of FIG. 1.

Additionally shown in FIG. 5 is central aperture 56 and diverting surface 58. Also the boundary wall 68 between atomizing air chamber 54 and pattern adjusting air chamber 60 is clearly shown in this view.

It will be apparent from the above description that this invention provides a method of adjusting the spray pattern during the continuous operation of the spray nozzle by the simple movement of the spray pattern adjusting lever so as to align the ports of the pattern adjusting plate with the ports leading to the pattern adjusting nozzles. The various combinations of pattern adjusting plate ports and operational pattern adjusting nozzles creates different spray patterns which may be utilized in different areas of a process such as spray painting. Additionally the utilization of a turbulence surface and a streamlining, directionalizing of the atomizing air at the frusto-conical shaped aperture of the atomizing air chamber around the fluid nozzle produces a more efficient utilization of the atomizing air thereby requiring less air for the atomization and operation of a spray gun with the consequent reduction in energy and pollution costs.

Having thus described this invention, what is claimed is:

1. A spray nozzle for use with air atomizable liquids comprising:

a first air chamber having an outlet end;

a reciprocably mounted fluid nozzle valve having a conical taper prenetrating said first air chamber and extending to and coaxially aligned with a central circular aperture in the outlet end of said first air chamber;

means for delivering a liquid to said central aperture for atomization by air exiting said chamber through said aperture;

integral means at said outlet end for creating turbulence in the air in said chamber;

a second air chamber having an outlet end, at least two pattern adjusting nozzles disposed at the end of said second air chamber adjacent to the aperture of said first air chamber; and a pattern adjusting plate for selectively blocking said second air chamber from said pattern adjusting nozzles.

2. The apparatus according to claim 1 wherein the outlet end of said first air chamber has a converging frusto-conical shape which terminates at a cylindrical duct, said duct leading to the atmosphere.

3. The apparatus according to claim 2 wherein said turbulence creating means comprises a V-shaped groove concentrically disposed in said outlet end about said central aperture.

4. The apparatus according to claim 1 wherein said second air chamber is annularly disposed about said first air chamber.

5. The apparatus according to claim 1 wherein each pattern adjusting nozzle is located in a nozzle ear which projects beyond the plane of said central aperture.

6. The apparatus according to claim 3 wherein said pattern adjusting plate is a ring configured to abut the outlet end of said second air chamber.

7. The apparatus according to claim 1 wherein said pattern adjusting plate has ports which may be movably aligned with pattern adjusting nozzles.

8. A apparatus according to claim 5 wherein two pattern adjusting nozzles are located on diagonally opposite sides of said aperture.

* * * * *